US005347246A

United States Patent [19]

Bellows et al.

[11] Patent Number: 5,347,246

[45] Date of Patent: Sep. 13, 1994

[54] MOUNTING ASSEMBLY FOR DIELECTRIC RESONATOR DEVICE

[75] Inventors: Alfred H. Bellows, Wayland; Frederick A. Loughridge, Ipswich, both of Mass.

[73] Assignee: GTE Control Devices Incorporated, Standish, Me.

[21] Appl. No.: 968,635

[22] Filed: Oct. 29, 1992

[51] Int. Cl.[5] ..... H01P 7/10

[52] U.S. Cl. ..... 333/219.1; 331/96

[58] Field of Search ..... 333/202, 219, 219.1, 333/234, 235; 331/96, 107 DP

[56] References Cited

U.S. PATENT DOCUMENTS 4,477,788 10/1984 Collinet et al. ..... 333/202 X 4,488,124 12/1984 Yoshimura ..... 333/230 X 5,200,721 4/1993 Mansour ..... 333/219.1 X

FOREIGN PATENT DOCUMENTS 0112103 7/1982 Japan ..... 333/219.1

0134902 8/1984 Japan ..... 333/202

0162806 6/1992 Japan ..... 331/96

*Primary Examiner*—Seungsook Ham

*Attorney, Agent, or Firm*—Martha Ann Finnegan

[57] ABSTRACT

A dielectric resonator device includes an enclosure having a bottom wall, a pedestal made of quartz seated inside the enclosure on the bottom wall, a dielectric resonator element seated on the pedestal, a bracket made of quartz for holding the dielectric resonator down on the pedestal and a clamping disc and screws for securing the bracket to the bottom wall.

5 Claims, 6 Drawing Sheets

MOUNTING ASSEMBLY FOR DIELECTRIC RESONATOR DEVICE

BACKGROUND OF THE INVENTION

The present invention relates generally to dielectric resonator devices and more specifically to dielectric resonator devices in which a dielectric resonator element is mounted inside a cavity.

Dielectric resonator devices in which a dielectric resonator element is mounted inside a cavity are well known in the art. Such resonator devices should ideally have the dielectric resonator element levitated in the center of the surrounding cavity with absolute precision and rigidity.

Idealism aside, many mounting methods have been used to approximate such a geometry with varying degrees of success. Generally, these methods suffer from thermal instabilities, overheating or dimensional shifting, or from resonant degradation wherein the support structure affects the frequency or the quality factor, Q.

In U.S. Pat. No. 5,097,238 to M. Sato et al there is disclosed a cavity type dielectric resonator device comprising a dielectric resonator body of dielectric ceramic having a resonator portion, a supporting portion and a mounting flange portion, the mounting flange portion being on the lower end of the supporting portion, a base member for mounting the dielectric resonator body, and fastening members for removably fixing the mounting flange on the base member, wherein the resonator portion and the mounting flange portion are integrally formed, the mounting flange portion of the resonator body and the base member have bores through which said fastening members are fastened, and the fastening members comprise bolts and nuts of dielectric ceramic material.

Also disclosed in U.S. Pat. No. 5,097,238 to M. Sato et al is a cavity type dielectric resonator device which includes a dielectric resonator element, a metal casing and an insulating holder made of alumina or forsterite. The dielectric resonator element is mounted on the upper portion of insulating holder and secured thereto by an adhesive layer while the lower portion of the insulating holder is secured to an annular metal flange by an adhesive layer. The annular metal flange is secured to the metal casing by bolts and nuts.

In U.S. Pat. No. 5,111,170 to K. Ohya there is disclosed a cavity type dielectric resonator device comprising a dielectric resonator body of dielectric ceramics having an inner bore provided along the axis thereof, a pedestal having an inner bore provided along the axis thereof, a shield casing for containing the resonator body and the pedestal, and a fastening member inserted into the inner bores of the resonator body and the pedestal for fastening and fixing them on the base wall of the shield casing, wherein the shield casing and the fastening member are provided with openings for circulating a cooling gas in the shield casing, respectively. In one version of the device the resonator body and pedestal are separate members while in another version of the device the resonator body and pedestal are a unitary structure.

Also disclosed in U.S. Pat. No. 5,111,170 to K. Ohya is a cavity type resonator device which includes an annular shaped resonator element, an annular shaped support and a bolt and nut for holding the resonator element down on the support and the support on the base wall of a shield casing. In addition, there is disclosed a cavity type resonator device which includes a base wall, a support secured to the base wall by an adhesive member and a resonator element secured to the support by an adhesive member.

Other known U.S. patents of interest include U.S. Pat. No. 4,121,181 to T. Nishikawa etc., U.S. Pat. No. 4,136,320 to T. Nishikawa etc, and U.S. Pat. No. 4,620,168 to X. Delestre et al.

It is an object of this invention to provide a cavity type dielectric resonator device which includes an arrangement for mounting the dielectric resonator element inside the cavity using low loss materials in a mechanically stable configuration.

SUMMARY OF THE INVENTION

A dielectric resonator device constructed according to the teachings of this invention includes an enclosure having a bottom wall, a dielectric resonator element, and an assembly for mounting the dielectric resonator element inside the enclosure on the bottom wall.

In one embodiment of the invention the assembly includes a pedestal made of quartz and a bracket made of quartz, the dielectric resonator element being seated on the pedestal and the bracket being arranged so as to press the resonator element down on the pedestal. In another embodiment of the invention the assembly includes a bracket made of quartz, the dielectric resonator element being fixedly secured to the bracket, and in still another embodiment of the invention the assembly includes a bracket made of quartz and the dielectric resonator element is removably attached to the bracket.

Various features and advantages will appear from the description to follow. In the description, reference is made to the accompanying drawing which forms a part thereof and in which is shown by way of illustration, specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts:

FIG. 1(*a*) is an enlarged fragmentary section view of the dielectric resonator device shown in FIG. 1;

FIG. 7(*a*) is a top view of the jig shown in FIG. 7;

DETAILED DESCRIPTION OF PREFERRED EMBODIMENTS

The present invention is directed to a dielectric resonator device. The device may be used as a filter or an oscillator in microfrequency regions.

Figure 1:
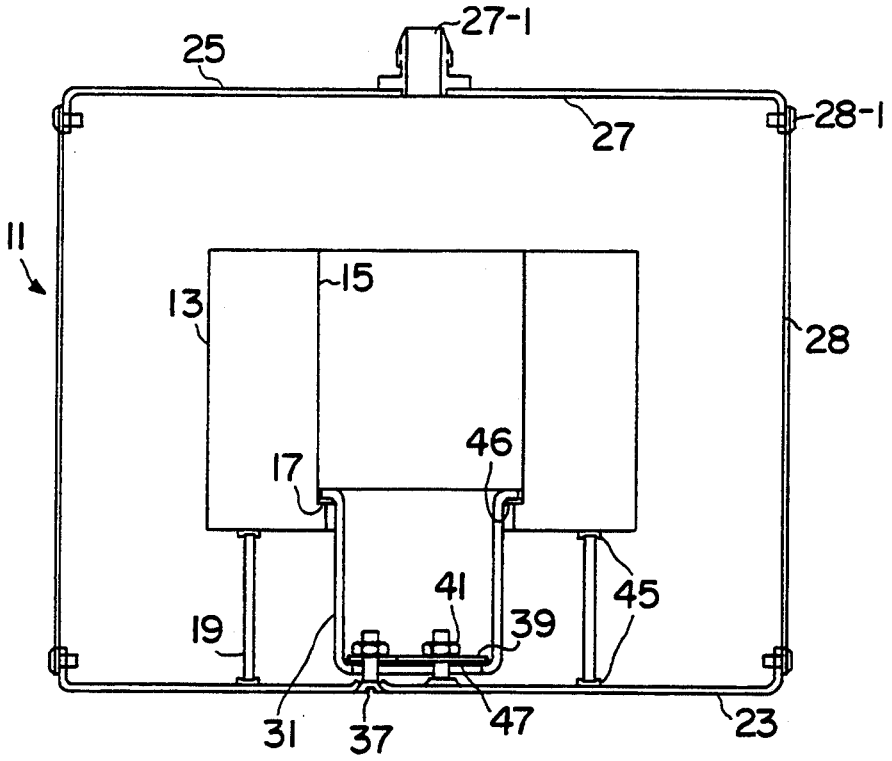
FIG. 1 is a section view of one embodiment of a dielectric resonator device constructed according to the teachings of the present invention.
Figure 1A:
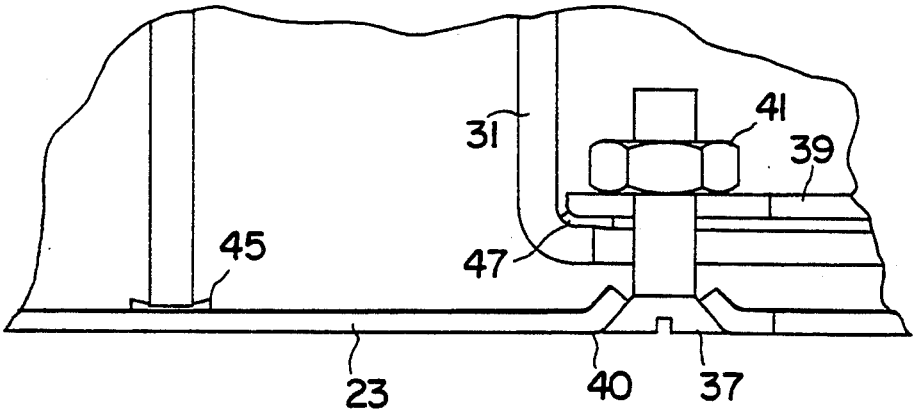

Referring now to the drawings there is shown in FIG. 1 a section view of one embodiment of a dielectric resonator device constructed according to the teachings of the present invention, the dielectric resonator device being identified by reference numeral 11.

Dielectric resonator device 11 includes a dielectric resonator element 13 of a cylindrical type and which may be made of a dielectric ceramic material having a high dielectric constant and a low dielectric loss such as $TiO_2$. Dielectric resonator element 13 has an inner bore 15 which is shaped near the bottom to define an annular shoulder 17.

Figure 2:
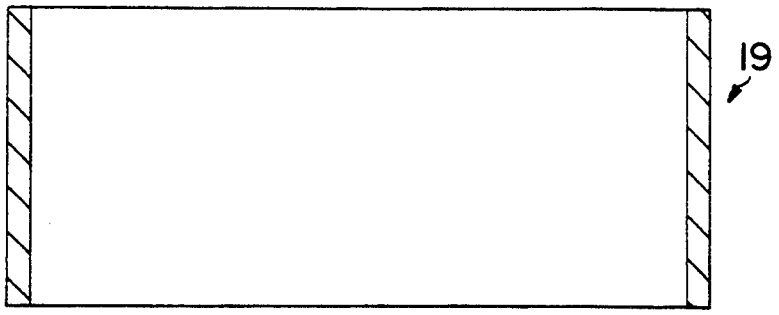
FIG. 2 is a section view of the pedestal in the dielectric resonator device shown in FIG. 1.

Dielectric resonator element 13 is seated on a tubular shaped pedestal 19 which is made of quartz. A separate view of pedestal 19 is shown in FIG. 2. Pedestal 19 is seated on the bottom wall 23 of an enclosure 25, the inside of enclosure 25 defining an air cavity. In addition to bottom wall 23, enclosure 25 includes a top wall 27 having an opening 27-1 which permits frequency tuning components to be installed and a cylindrically shaped side wall 28. Enclosure 25 may also include openings (not shown) through which cooling air may enter and exit. The walls are secured in place by fasteners 28-1.

Figure 3:
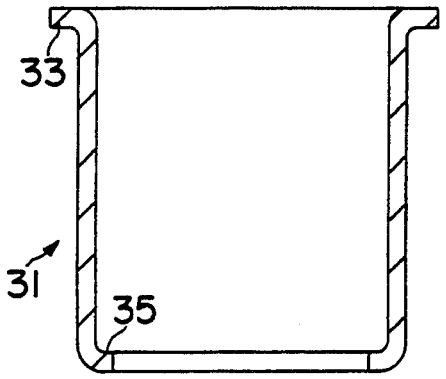
FIG. 3 is a section view of the bracket in the dielectric resonator device shown in FIG. 1.
Figure 4:
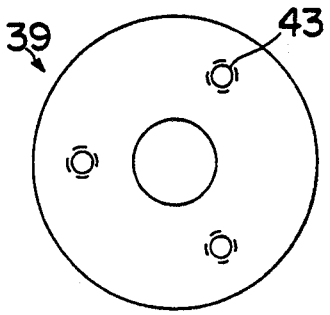
FIG. 4 is a top view of the clamping disk in the dielectric resonator device shown in FIG. 1.

Dielectric resonator element 13 is held down in place on pedestal 19 by a bracket 31 which is made of quartz. Bracket 31, which is shown separately in FIG. 3, is a hollow generally cylindrically shaped member having an outwardly flaring flange 33 at the top and an inwardly flaring flange 35 at the bottom. Flange 33 at the top of bracket 31 is seated on shoulder 17 of dielectric resonator element 13. Bracket 31 is removably secured to bottom wall 23 of enclosure 25 by mounting screws 37, a clamping disk 39 and locking nuts 41. A top view of clamping disk 39 is shown in FIG. 4. Screws 37 extend up through mounting holes 40 (FIG. 1(*a*)) formed in bottom wall 23 and then screwed into threaded holes 43 formed in clamping disk 39. Clamping disk 39, as can be seen, is seated on inwardly flaring flange 35 of bracket 31. Clamping disk 39, mounting screws 37 and locking nuts 41 may be made of a metal such as steel, stainless steel, invar or copper and may be copper plated to reduce loss to improve resonant performance of the assembly. Gaskets 45, 46 and 47 (FIG. 1) which are made of silicone or other material with good dielectric properties may be provided at each of the contact points of pedestal 19 or bracket 31 to minimize the risk that a burr or other anomaly may initiate a fracture. Since bracket 31 cannot be firmly tightened against bottom wall 23 and since the tightness of screws 37 determines the tension in bracket 31, screws 37 must be tightened to a carefully controlled degree and maintained at that tightness. Nuts 41 which can be locked against the threaded holes in clamping disk 39 serve this function. Alternatively, a locking thread in the clamping disk could serve this function.

Figure 5:
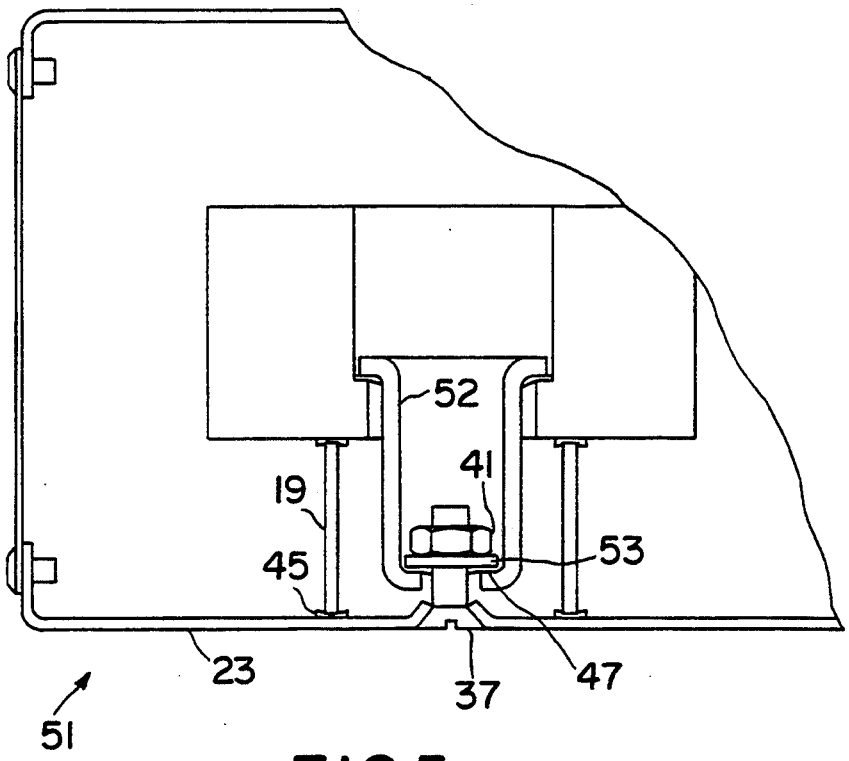
FIG. 5 is a fragmentary section view of another embodiment of a dielectric resonator device constructed according to the teachings of the present invention.
Figure 6:
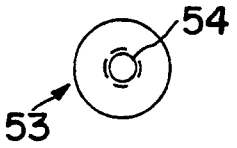
FIG. 6 is a top view of the clamping disk shown in FIG. 5.

Referring now to FIG. 5 there is shown a fragmentary section view of another embodiment of a dielectric resonator device constructed according to this invention and identified by reference numeral 51. Device 51 differs from device 11 in that bracket 52 is somewhat smaller in cross section than bracket 31 and is held down on the bottom wall 23 using a single mounting screw 37, a single locking nut 41 and a clamping disk 53 having a single centrally located threaded hole 54. A top view of clamping disk 53 is shown in FIG. 6.

Figure 7:
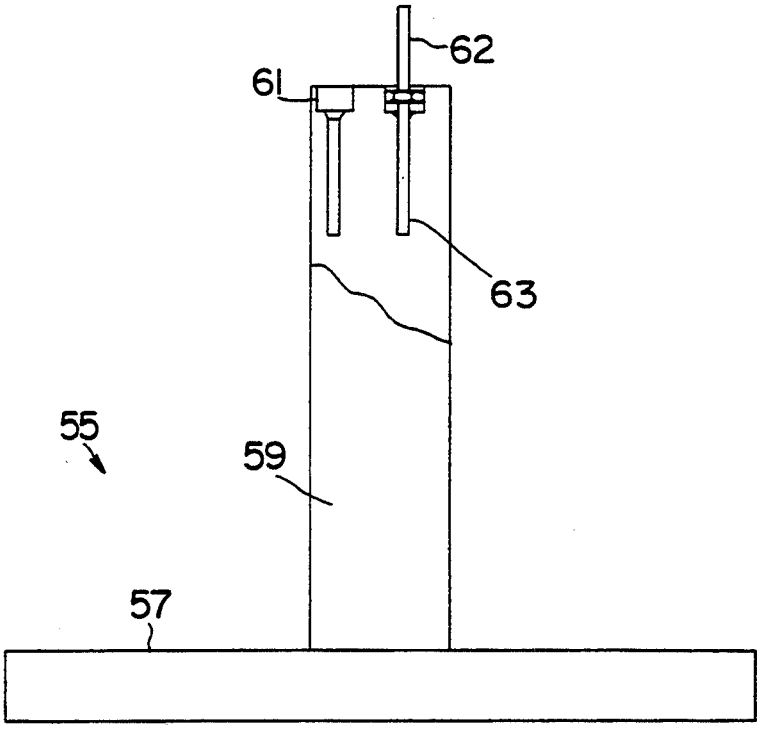
FIG. 7 is a side view partly broken away in section of a jig for use in assemblying the dielectric resonator device shown in FIG. 1.
Figure 7A:
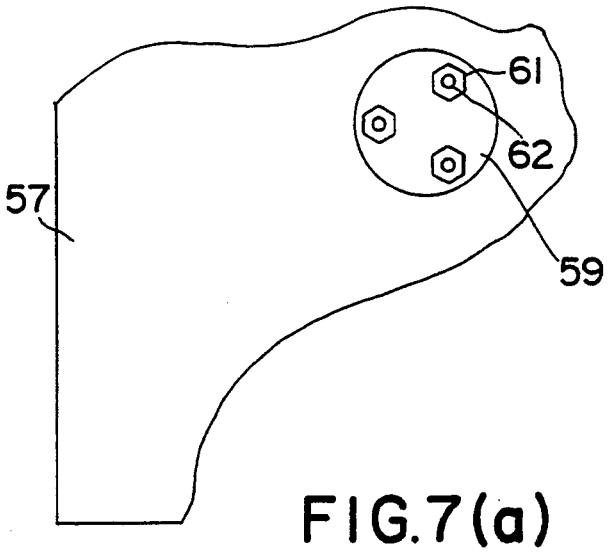
Figure 8:
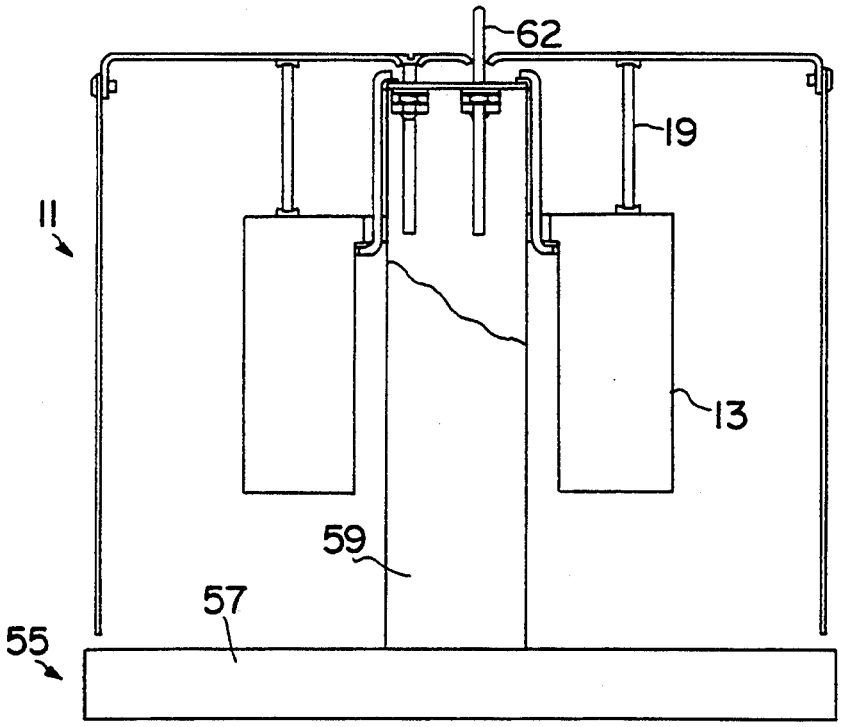
FIG. 8 is a section view showning the dielectric resonator device in FIG. 1 being assembled on the jig illustrated in FIG. 7.

Referring now to FIG. 7 there is shown a section view of a jig 55 which may, if desired, be used in assembling resonator 11 according to this invention. A fragmentary top view is shown in FIG. 7(*a*). Jig 55 includes a base 57. A support column 59 is mounted on base 57. Support column 59 has hexagonal recesses 61 to match the pattern of locking nuts 41. A set of guide pins 62 are removably installed in bores at the center of the hexagonal recesses 61. A view showing assembly 11 mounted on fixture 55 is illustrated in FIG. 8.

In using assembly 55 hexagonal nuts 41 are placed in sockets 61, and guide pins 62 are inserted. Resonator assembly 11 is then assembled in its inverted position in the following manner. Clamping disk 39 and gasket 47 are placed on top of column 59. Bracket 31 is then placed on gasket 47 and clamping disk 39. Gasket 46 and resonator element 13 are then placed over bracket 31. Pedestal 19 with one gasket 45 at each end is then placed on resonator element 13. Enclosure 25 is then placed onto the previously assembled components. Guide pins 62 are then removed one at a time and replaced with a mounting screw 37 threaded through both the clamping disk 39 and the nut 41.

After all screws 37 are in place and adjusted to their proper tightness, the resonator device is removed from the jig 56 and nuts 41 are respectively tightened to lock the device in place.

Figure 9:
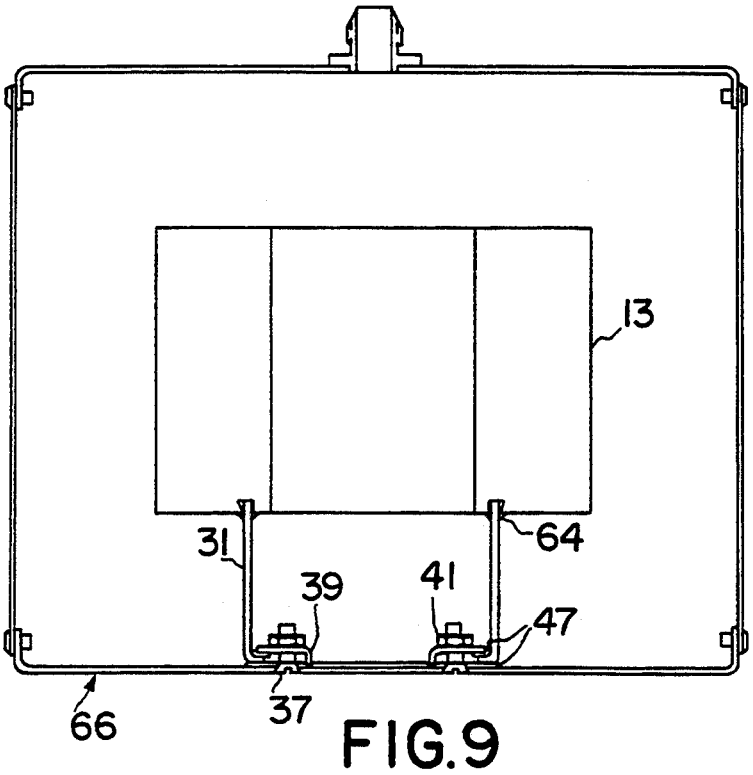
FIG. 9 is a fragmentary section view of another embodiment of a dielectric resonator device in which the bracket is permanently attached to the resonator element.

Referring now to FIG. 9 there is shown another embodiment of the invention, the embodiment being identified by reference numeral 66. In device 66 there is no pedestal. Instead, resonator element 13 is fixedly secured to bracket 31 by cement 64 or other adhesive.

Figure 10:
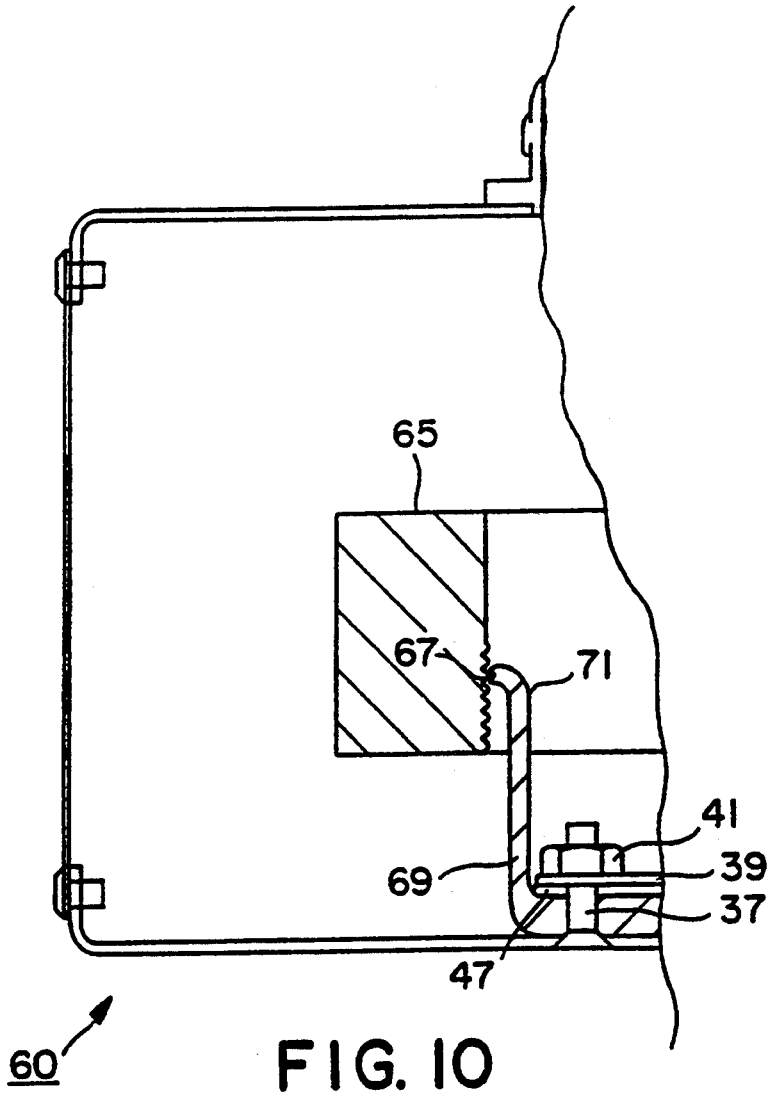
FIG. 10 is a fragmentary section view of another embodiment of a dielectric resonator device in which the bracket is removably attached to the resonator element.

In FIG. 10 there is shown another embodiment of the invention identified by reference numeral 60. Device 60 includes a resonator element 65 which is similar to resonator element 13 but internally threaded on its inner wall 67 and a bracket 69 which is similar to bracket 31 but threaded on its top flange 71. In assembling device 60, resonator element 65 is screwed onto bracket 69.

The unique features of the dielectric resonator device of this invention fall into three general categories, namely, thermal characteristics, dielectric characteristics, and physical geometry.

Thermally, this arrangement is attractive because quartz has very low thermal expansion and moderate thermal conductivity. The virtually zero thermal expansion (about 0.5 ppm/C or 3 to 4% of that of other materials used in the assembly) results in extremely little shifting of the components as the equipment warms up during use. Moreover, both its open structure and its moderate thermal conductivity promote thermal transfer from the ceramic resonator to the cavity enclosure via convection and conduction. Thus temperature rise is minimized. These features combine to minimize the shifting of the resonant frequency or the degradation of Q.

The dielectric properties of quartz are nearly ideal for this device. Firstly, quartz has a low dielectric constant which minimizes the effect of this asymmetrical hardware on the symmetry of resonant phenomena. This means that spurious resonance modes and, therefore, spurious frequencies and interfering intermodulation products should not occur, or at worst, be minimal. It also means that the magnetic field within the cavity will not be displaced by the hardware and, therefore, will not degrade Q. Secondly, quartz has a low dissipation factor which means that its presence in the cavity should not degrade significantly the Q of the complete assembly.

The physical geometry of this mounting structure also has attractive features. Although quartz is far from an ideal material for building structures, it lends itself well to being manufactured with minimal residual stress, thereby minimizing the adversity of using a vitreous material in such an application. The pedestal component can be of large diameter to provide good support and rigidity while minimizing stress. The use of gaskets at the contact points should minimize the local stresses which are typically responsible for initiating cracks in brittle materials. Moreover, the ends can be fire polished to further increase the resistance to fracture. The quartz bracket is under greater stress, but its contours are generously radiused, its contact points buffered with gaskets, and its surfaces fire polished. Additionally, the metal clamping means is slightly resilient and springly. Thermally induced strains are minimized by designing the low expansion pedestal and bracket to be of nearly equal length while the high expansion clamping flange and mounting screw are also of nearly equal length. Slight mismatches in thermal expansion between flange material and screw material can be offset by adjusting the relative lengths of these components. Also, the hollow, tubular nature of this structure permits frequency tuning components (not shown) to be installed in the central hole of the ceramic resonator and adjusted with a threaded rod extending from the mounting end up through the structure. Thus, optimal stability of the tuning device relative to the ceramic resonator is also provided.

Departures from the above described configuration can be made without departing from the intention of this design. For example, cleats could be stamped into or attached to the floor of the cavity to accurately locate and center the quartz pedestal within the cavity. Similarly a groove or rim formed onto the ceramic resonator can be used to locate it with respect to the pedestal. Such features should be oriented such that the large thermal expansion mismatch does not result in inducted stresses. Also, the clamping disk may be provided with additional springiness to accommodate thermal expansion particularly if the following configuration is incorporated. Also, the quartz bracket may extend further up the ceramic resonator to grip against its top surface thereby avoiding the need for an internal flange and perhaps providing an additional structure for the tuning component to slide along. In addition, the gaskets may be molded in place using beads of RTV type silicone thereby providing additional lateral stability to the assembly through the adherence of the sealant.

What is claimed is:

1. A dielectric resonator device comprising:
   a. an enclosure having a bottom wall,
   b. a pedestal seated inside said enclosure on said bottom wall, said pedestal being made of quartz.
   c. a dielectric resonator element seated on said pedestal,
   d. a bracket for holding said dielectric resonator down on said pedestal, said bracket being made of quartz, and
   e. means for securing said bracket to said bottom wall.

2. The dielectric resonator device of claim 1 and wherein said pedestal is hollow and cylindrically shaped.

3. The dielectric resonator device of claim 2 and wherein said bracket is hollow and cylindrically shaped and has a top end and a bottom end and wherein said top end has an outwardly flaring flange and said bottom end has an inwardly flaring flange.

4. The dielectric resonator device of claim 3 and wherein said securing means includes a clamping disk seated in said bracket on said inwardly flaring bottom flange and a fastener extending through a hole in said bottom wall and in threaded engagement with said clamping disk.

5. The dielectric resonator device of claim 4 and further including a locking nut for holding said clamping disk down on said bracket.

* * * * *